US006364146B1

(12) United States Patent
Beckerer, Jr.

(10) Patent No.: US 6,364,146 B1
(45) Date of Patent: Apr. 2, 2002

(54) ACCESS SCREW COVER FOR CONTAINERS AND ENCLOSURES

(76) Inventor: Frank S. Beckerer, Jr., 199 Gulf St., Milford, CT (US) 06460

( * ) Notice: Subject to any disclaimer, the term of this patent is extended or adjusted under 35 U.S.C. 154(b) by 0 days.

(21) Appl. No.: 09/589,296

(22) Filed: Jun. 7, 2000

(51) Int. Cl.[7] ..... B65D 39/08

(52) U.S. Cl. ..... 220/288; 220/304; 215/356; 215/302; 215/305

(58) Field of Search ..... 220/288, 304, 220/254, 284, 601; 215/356, 357, 302, 303, 305; 411/403, 405, 919; 138/96 T; 81/3.45, 436, 439, 461

(56) References Cited

U.S. PATENT DOCUMENTS 2,235,617 A * 3/1941 Klinzing ..... 220/288
3,173,569 A * 3/1965 Craig ..... 220/288
3,380,618 A * 4/1968 Phillips ..... 220/288
3,470,786 A * 10/1969 Martins
3,904,072 A * 9/1975 Whiteside ..... 220/288
4,005,799 A * 2/1977 Mannaerts ..... 220/288
4,280,434 A * 7/1981 Beckerer, Jr. ..... 220/288
4,785,963 A * 11/1988 Magley ..... 220/288
5,598,753 A * 2/1997 Lee
5,647,712 A * 7/1997 Demirdogen et al. ..... 411/919
5,680,953 A * 10/1997 Baughman ..... 220/288

* cited by examiner

*Primary Examiner*—Nathan J. Newhouse
(74) *Attorney, Agent, or Firm*—Cummings & Lockwood

(57) ABSTRACT

An access screw cover for containers and enclosures is disclosed which includes a closure body having a first and a second abutment mechanism associated therewith and a circular peripheral surface which defines a central axis. The circular peripheral surface is intended to fit the peripheral surface of the closure opening. The first abutment means presenting a shoulder which, when force is applied thereto, tends to turn the body forcibly in one direction. The second abutment means presenting a shoulder which, when force is applied thereto, tends to turn the body in the opposite direction.

21 Claims, 2 Drawing Sheets

Fig: 1
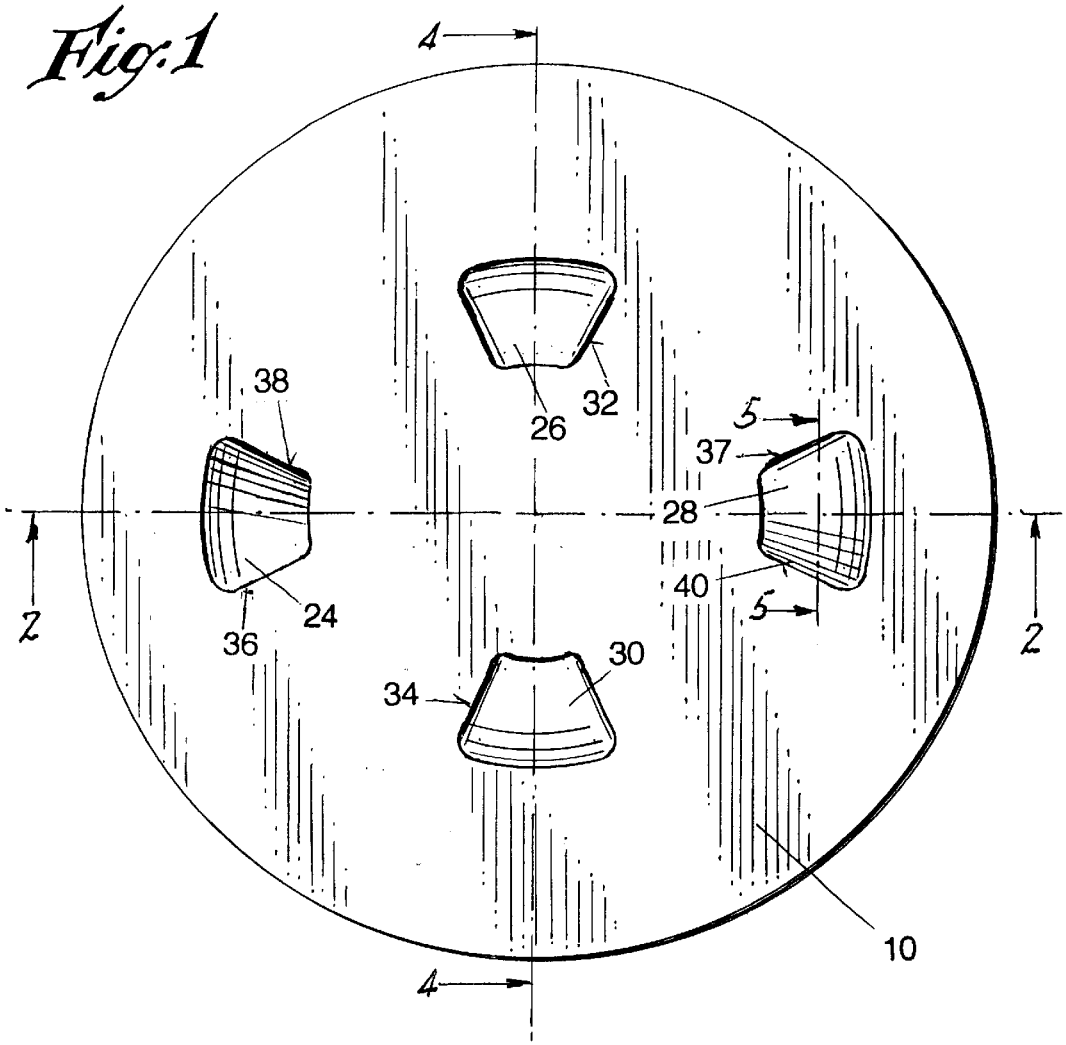
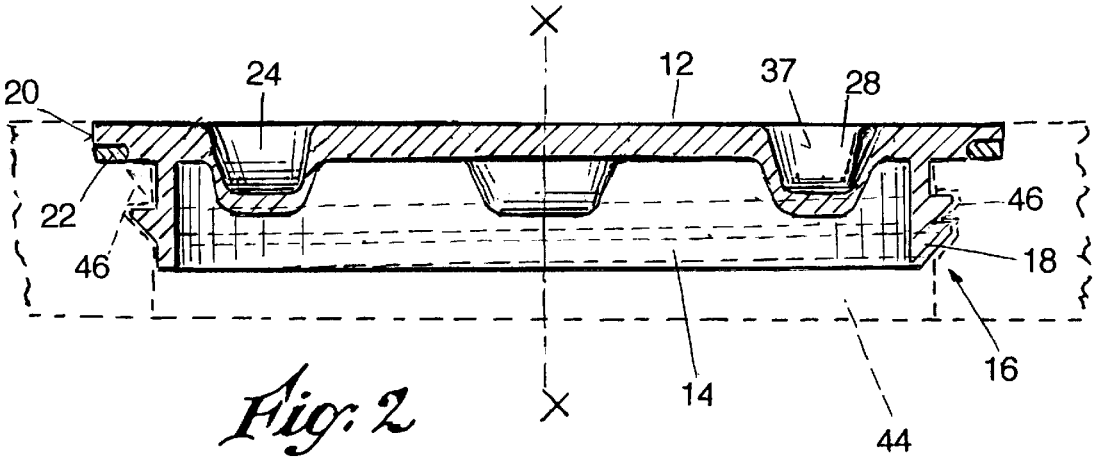
Fig: 2

ACCESS SCREW COVER FOR CONTAINERS AND ENCLOSURES

NO CROSS REFERENCES TO RELATED APPLICATIONS

STATEMENT AS TO RIGHTS TO INVENTIONS MADE UNDER FEDERALLY-SPONSORED RESEARCH AND DEVELOPMENT

Research and development of the present invention and application have not been Federally-sponsored, and no rights are given under any Federal program.

BACKGROUND OF THE INVENTION

1. Field of the Invention

This invention relates to closures for containers or A enclosures, and more particularly to closures of the type employing threaded means to ensure the tightness and seal of the closure.

2. Description of the Related Art Including Information Disclosed Under 37 CFR 1.97–1.99

Various types of threaded closures have been proposed and utilized in the past. These closures have in general employed thread-like cooperable means to effectuate a tight seal. In some instances the thread-like means was single-acting in effect, as in the nature of buttress threads. In other cases, the thread-like means had sharp crests or else rounded crests, depending on the desired circumstances.

More specifically, the present invention relates to thread formations carried by closure members of different diameters by which various forces and leverages may be applied to the closure body either by hand or with a tool to obtain specific different results.

In U.S. Pat. No. 882,877 a closure is provided for use as a deck plate, such closure having spring-loaded detent pins "P" to yieldably hold the plate in any of various rotative positions. No positive screw-action locking is disclosed or contemplated.

U.S. Pat. No. 849,618 shows a deck plate having a flush lever type lock which when lifted releases the closure 8 for removal. This patent also does not disclose a screw-type locking action. Release is effected by the same movement which is used to lift the closure out of its sealing position.

In the Ely Pat. No. 829,862 a slide bolt 6 is spring charged to locking position and can be retracted by sliding the release knob 9 to the right as viewed in Sectional view FIG. 4.

U.S. Pat. No. 304,684 issued to Adams is poorly gotten up. Presumably there are cam surfaces (marked in pencil) which operate dogs 'b4' to effect the release. No screw action occurs but in general it is dissimilar to the general trend of deck plates found in a search of the art.

In Webster Pat. No. 1,125,229 a filler tube cap in the form of a screw is disclosed. Projections 36 act as finger-engageable grips to enable gripping of the closure body for turning it to either closed or open position.

U.S. Pat. No. 3,707,241 features an internally threaded closure d and a reinforcing means for strengthening and backing the mouth portion of the container. This is applied especially in connection with thin-walled containers.

Of more particular interest is U.S. Pat. No. 4,246,859 which reveals a boat deck cover which is similar in many respects to the cover which is the subject of the present invention. The cover plate construction of the patent reveals cooperable buttress threads 28 and 30 having special dimensions to provide a certain amount of slop between them. No other special features are provided on the cover plate for facilitating either the loosening action or the tightening action of the plate. A resilient sealing washer 46 is carried by the stationary fitting of the closure assemblage to effect the seal. However, such arrangement has drawbacks since the washer is subject to being scruffled and damaged, thereby adversely affecting the seal.

In U.S. Pat. No. 4,280,434 a cover plate construction is provided which cooperates with a resilient washer also on the deck fitting, to obtain a seal. The object is to compensate for fluctuations or variations of the cover plate and eliminate strain or warping effects that might occur should the cover plate become malformed.

Very often closures are found to be more difficult to open than to close. In some cases this turns out to be of distinct disadvantage, especially where a proper opening tool is not available. To cope with this, various types of wrenches can be employed in conjunction with prior closures in order to secure easy opening movements.

SUMMARY

The above pointed-out drawback and disadvantages of prior screw operated seals are obviated by the present invention, which has for one object the provision of an improved easily closable and also easily openable closure or sealing plate of the screw variety, which can, if desired, be readily economically fabricated of durable plastic substance or other material in a configuration that is adaptable to either hand or tool operation and is also especially rugged, being capable of an extended long life.

Another object of the invention is to provide an improved screw-type cover plate for sealing an opening as above set forth, which is easily operated in various modes as to its being tightened and loosened.

A further object of the invention is to provide an improved thread-type closure as characterized which has different capabilities with respect to the opening and closing forces that are needed. In some circumstances a relatively small releasing or turning force is sufficient to remove the closure body.

A still further object of the invention is to provide an improved thread-type closure as above described, which can remain flush with the surface to which it is attached when in a sealing position.

An additional object of the invention is the provision of an improved screw-type cover plate as above characterized, which can be very economically molded of plastic substances, and yet remain strong and durable for the purposes desired.

Yet another object of the invention is to provide an improved threaded closure of the type indicated, wherein great forces can be exerted thereon as by an operating wrench, due to the shaping and disposition of shoulders or recesses in the closure body, and by the configuration of the recess walls thereof.

A feature of the invention resides in the directional function of the opening and closing means or recesses to favor either opening or closing of the access plate, as the case may be.

An important feature of the invention is that the placement of the opening and closing finger or wrench holes provides a lower but sufficient amount of torque to close the cover utilizing the innermost grips, and a higher degree of torque to open the cover by utilizing the outermost grips.

Also that the outermost, opening finger grips are unidirectional in that they are designed to slip at minimum resistance, so that they are not useful to close the cover at the higher torque level.

Another feature of the invention resides in the simplicity of the structures involved in achieving the above results.

Other features and advantages will hereinafter appear.

BRIEF DESCRIPTION OF THE DRAWINGS

In the accompanying drawings:

FIG. 1 is a top plan view of the improved thread-type closure plate of the invention.

FIG. 2 is a diametric section of the closure plate, taken on the line 2—2 of FIG. 1.

DESCRIPTION OF THE PREFERRED EMBODIMENT

Figure 3:
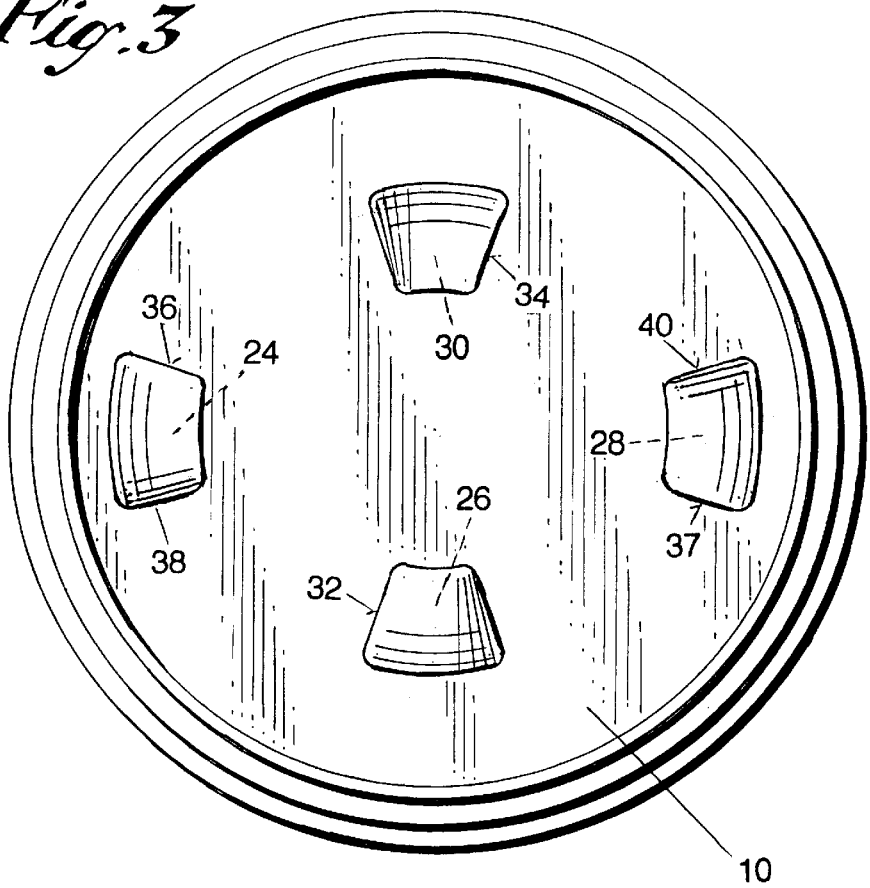
FIG. 3 is a bottom or underside, plan view of the closure plate.
Figure 4:
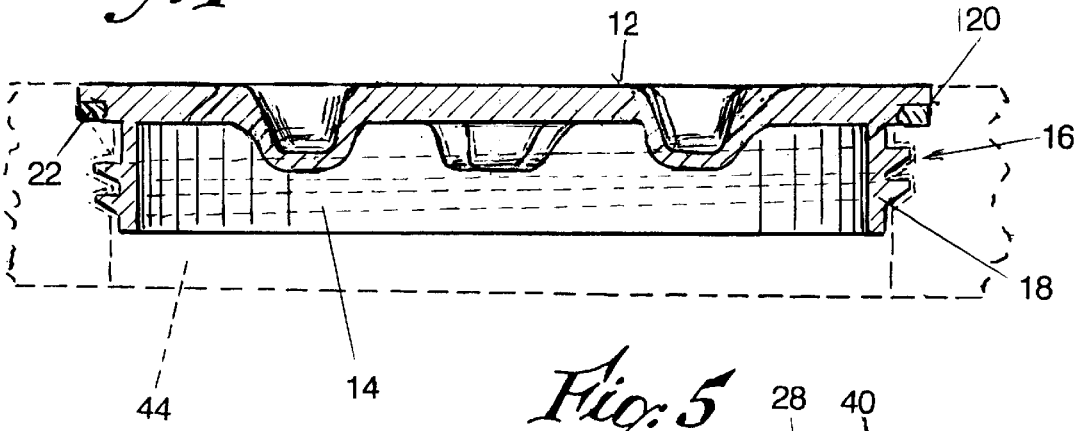
FIG. 4 is a diametric section taken on the line 4—4 of FIG. 1.
Figure 5:
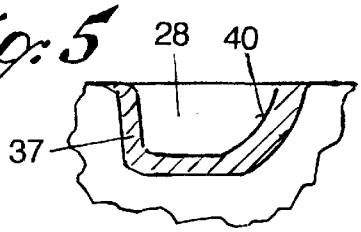
FIG. 5 is a fragmentary section of the closure plate, taken on the line 5—5 of FIG. 1.

Referring to the figures, the plan view of the threaded closure is shown herein comprising a disk-like closure body 10 having a planar top surface 12 and a peripheral depending flange portion 14 which latter depends from the top surface and has peripherally-disposed thread-like means comprising a buttress thread formation 16 which, according to the invention, is preferably constituted of a multiple buttress thread 18. Above the flange 14 is a circular peripheral surface 20 which surrounds the top flat surface 12 and defines a peripheral groove in which is disposed a resilient sealing washer 22.

The nature of the closure body 10 is generally in the configuration of a low flat cylindrical cup preferably of relatively large diameter. The buttress thread 18, for example, can be in excess of 9 inches in diameter.

The closure body 10 is preferably molded of tough plastic substance having, for example, fiberglass reinforcement material, and the buttress thread 18 can extend through essentially one and one-half turns arc.

The above measurements and relationships are given by way of example. It will be understood that the closure body 10 can have various departures from the above shape and embodiments illustrated in the drawings.

According to the invention the cover body 10 is provided with unique abutment means in the form of sets of sockets or recesses that present shoulders or abutments for manipulating or turning it, such means being illustrated herein as unidirectional socket grips or recesses 24, 26, 28 and 30 which are fabricated or molded in the flat top surface 12. The recesses 24, 26, 28 and 30 comprise two pairs which are disposed respectively opposite each other along diametric lines. These recesses are for the purpose of forcibly turning the closure body 10 in either tightening or screwing-on direction, or else in loosening or screwing-off direction. It is preferred that the recesses 26 and 30 be spaced apart a distance which is less than the spacing of the recesses 24 and 28 for the purpose of providing lesser leverage and that the recesses 26 and 30 be especially configured to adapt them to closing or tightening movement of the plate 10 whereas the recesses 24 and 28 be configured or adapted for use in opening the plate.

By the invention the recesses 26 and 30 have opposite angularly inclined side walls 32 and 34, which lie in planes that generally pass through the center or axis X—X of the closure body and are perpendicular to such axial plane. In other words, the surfaces 32, 34 if extended would pass through the plane containing the center of the closure body 10. By such disposition these surfaces 32 and 34 (hereinafter also referred to as vertical surfaces) are capable of having a gripping relationship with an operating tool which contains shoulders for engagement therewith. By such arrangement the closure body 10 can be very forcibly turned or screwed on tightly.

In contrast with the above, the recesses 24 and 28 have one set of sides 36, 37 which are generally parallel with each other and contained in the axis which passes through the center of the closure body 10. These sides 36 and 37, by their disposition, are adapted for gripping relationship with either the fingers of a user s hand or else shoulders or lugs on the operating wrench, and enable a counterclockwise or opening force to be applied to the closure body 10. The remaining two sides 38, 40 of the recesses 24, 28 are not planar but instead curvilinear in configuration as seen by the surface shading in FIGS. 1 and 3. As a consequence, no secure gripping relationship can be established between such surfaces and the fingers of the user's hand or the lugs of the applied wrench. Thus these particular surfaces are of no use in tightening the closure body, but instead the surfaces 36, 37 are put in play for effecting the counterclockwise or loosening movement of the closure body.

Thus in addition to the differential spacing between the recesses of the pairs, the actual shape of the side surfaces are utilized for either loosening or tightening the closure body. By having the recesses 24 and 28 spaced apart more widely than the recesses 26 and 30, more torque can be readily applied on the closure due to the greater lengths of the arms of force that exist. The curvilinear nature of the side surfaces 38 and 40 can be seen from an inspection of FIG. 1. These surfaces can be oriented for either clockwise or counterclockwise preference and operation.

For cooperation with the closure body 10 any suitable container or supporting structure 44 (shown in dotted lines) may be provided having mating buttress threads 46 (preferably with a loose fit) with the buttress threads 18 of the closure body.

I have found that a filler or closure plate such as the plate 10 has advantages in enabling a tight closure of the body to be had, as well as facilitating loosening and removal of the same. The provision of the resilient sealing washer 22 which is carried by the closure body 10 is effective in preventing leakage from the container.

It will now be seen from the foregoing that the placement of the opening and closing finger or wrench holes provides a lower but sufficient amount of torque to close the cover utilizing the innermost grips and a higher degree of torque to open the cover by utilizing the outermost grips. Also that the outermost, opening finger grips are unidirectional in that they are designed to slip at minimum resistance, so that they are not useful to close the cover at the higher torque level.

The enclosure 44 has peripheral surfaces 46 which fit around the peripheral surfaces of the flange 14, as will be readily understood. Other thread configurations can be utilized.

Variations and modifications are possible without departing from the spirit of the invention.

Each and every one of the appended claims defines an aspect of the invention which is separate and distinct from the others, land accordingly it is intended that each claim be treated as such when examined in the light of the prior art devices in any determination of novelty or validity.

Listing of the reference numerals

10 closure body
12 body top surface
14 flange
16 buttress formation
18 buttress thread
20 circular peripheral surface
22 resilient sealing washer
24 recess
26 recess
28 recess
30 recess
32 side wall
34 side wall
36 side wall
37 side wall
38 side wall
40 side wall
44 container
46 peripheral surfaces

What is claimed is:

1. A threaded closure adapted to close a peripheral opening provided in a container comprising in combination:

a) a closure body having first and second abutment means associated therewith and a circular peripheral surface which defines a central axis, the circular peripheral surface is intended to fit the peripheral opening of the container, the first abutment means presenting a shoulder which, when force is applied thereto, tends to turn the body forcibly in one direction, the second abutment means presenting a shoulder which, when force is applied thereto, tends to turn the body in the opposite direction, wherein one abutment means is spaced farther from the closure body central axis than the other abutment means, b) the peripheral surfaces of the closure body and peripheral container opening having cooperable peripherally disposed structure to enable the closure body to be screwed into the peripheral opening of the container opening, c) said cooperable means responding to rotation of the closure body to engage the latter tightly so as to close the container opening.

2. A threaded closure as set forth in claim 1, wherein the peripherally disposed structure of the closure body extends through an arc which is essentially equal to 1½ turns.

3. A threaded closure as set forth in claim 1, wherein said peripherally disposed structure comprises threads in said closure body and in said peripheral opening of the container.

4. A threaded closure as set forth in claim 3, wherein said cooperable threads are contained mainly in the peripheral opening portion of the closure body.

5. A threaded closure as set forth in claim 1, wherein said peripherally disposed structure comprises a multi-turn thread formation.

6. A threaded closure as set forth in claim 5, wherein said thread formation has a diameter in excess of 9 inches.

7. A threaded closure as set forth in claim 1, wherein the closure body has a resilient seal adapted to be engaged with the surrounding opening.

8. A threaded closure as set forth in claim 7, wherein said closure body is formed of glass-reinforced material.

9. A threaded closure as set forth in claim 1, wherein:

a) said one abutment means comprises a pair of spaced-apart sockets in said closure body, located on opposite sides of the central axis thereof, b) said other abutment means comprising a second pair of spaced-apart sockets located at another pair of opposite sides of said axis, c) the spacing of the first pair of sockets from the axis differing from the spacing of the second pair of sockets from the axis.

10. A threaded closure as set forth in claim 9, wherein:

a) the spacing of the first pair of sockets being the lesser and being adapted to turn the closure body in the screwing-on direction of rotation.

11. A threaded closure as set forth in claim 9, wherein:

a) the spacing of the first pair of sockets being the greater and being adapted to turn the closure body in the screwing-off direction of rotation.

12. A threaded closure as set forth in claim 11, wherein:

a) said sockets have opposite sides of differing slopes, b) one of said opposite sides being sloped to effect a turning of the closure body in response to the application of force thereto, c) the other of said opposite sides being sloped to minimize the application of turning torque to the closure body.

13. A threaded closure as set forth in claim 1, wherein said closure body has recesses in its outer surface to enable a tool to be applied to it forcibly turn the body.

14. A threaded closure a set forth in claim 13, wherein two of said recesses in the outer surface of the closure body have especially sloped surfaces which do not favor grippage of the closure body by an applied tool.

15. A threaded closure a set forth in claim 13, wherein two of said recesses in the outer surface of the closure body have especially sloped surfaces which do not favor grippage of the closure body by the user's hand.

16. A threaded closure as set forth in claim 15, wherein said especially sloped surfaces of said recesses have curvilinear faces.

17. A threaded closure as set forth in claim 16, wherein the curvilinear surfaces of the recesses in the closure body are eccentric with respect to each other.

18. A threaded closure as set forth in claim 17, wherein said closure body has a total of at least four gripping recess surfaces.

19. A threaded closure as set forth in claim 18, wherein two of said recesses have curvilinear surfaces of differing characteristics with respect to the remainder of the surfaces of the recesses.

20. A threaded closure as set forth in claim 19, wherein said closure body is formed of molded plastic material.

21. A threaded closure as set forth in claim 20, wherein said closure body is formed of glass-reinforced material.

* * * * *